US010194731B2

(12) United States Patent
Guthrie et al.

(10) Patent No.: US 10,194,731 B2
(45) Date of Patent: Feb. 5, 2019

(54) STOWABLE AND ADJUSTABLE STERNUM STRAP

(71) Applicant: THE NORTH FACE APPAREL CORP., Wilmington, DE (US)

(72) Inventors: Ben Guthrie, San Francisco, CA (US); Greg Dailey, San Mateo, CA (US)

(73) Assignee: THE NORTH FACE APPAREL CORP., Wilmington, DE (US)

( * ) Notice: Subject to any disclaimer, the term of this patent is extended or adjusted under 35 U.S.C. 154(b) by 209 days.

(21) Appl. No.: 14/796,045

(22) Filed: Jul. 10, 2015

(65) Prior Publication Data

US 2017/0007009 A1 Jan. 12, 2017

(51) Int. Cl.

| | |
|---|---|
| ***A45F 3/04*** | (2006.01) |
| ***A45C 13/30*** | (2006.01) |
| ***A45C 13/10*** | (2006.01) |

(52) U.S. Cl.

CPC ..... *A45F 3/04* (2013.01); *A45C 13/103* (2013.01); *A45C 13/30* (2013.01)

(58) Field of Classification Search

CPC ..... A45F 3/04; A45C 13/30; A45C 13/103
USPC ..... 224/638, 637, 643, 647
See application file for complete search history.

(56) References Cited

U.S. PATENT DOCUMENTS

| | | | | |
|---|---|---|---|---|
| 6,802,442 | B1 * | 10/2004 | Thompson | A44B 11/14 224/259 |
| 2007/0284403 | A1 * | 12/2007 | Minami | A47D 13/02 224/160 |
| 2012/0102650 | A1 * | 5/2012 | McGlynn | A61G 1/00 5/627 |
| 2013/0185853 | A1 * | 7/2013 | Ricart | A45F 3/14 2/467 |
| 2014/0311635 | A1 * | 10/2014 | MacDonald | A45F 3/02 150/102 |
| 2015/0313346 | A1 * | 11/2015 | Doubleday | A45F 3/04 224/627 |

* cited by examiner

*Primary Examiner* — Nathan J Newhouse
*Assistant Examiner* — Lester L Vanterpool
(74) *Attorney, Agent, or Firm* — Hunton Andrews Kurth LLP

(57) ABSTRACT

The present disclosure provides an apparatus comprising a body, a pair of shoulder straps attached to the body, a pair of pockets, each of the pair of pockets being formed respectively in each of the pair of shoulder straps, and a sternum strap including two parts connectable with a connector, wherein each of the two parts is attached and can be stowed respectively inside of each of the pair of pockets. Each of the two parts has a first end attached to a first corner of the corresponding pocket and a second end attached to a second corner of the corresponding pocket, such that the connector can slide up or down along the two parts and, when the two parts are connected with the connector, each of the two parts forms a "V" shape.

16 Claims, 4 Drawing Sheets

STOWABLE AND ADJUSTABLE STERNUM STRAP

TECHNICAL FIELD

The present invention generally relates to sternum straps for backpacks and the like.

BACKGROUND

A sternum strap allows the user of a backpack to attach shoulder straps of the backpack across the chest of the user, thus keeping the backpack tightly in place and preventing the shoulder straps from sliding off the shoulders of the user.

However, conventional sternum straps do not provide enough degrees of freedom to the user. Sternum straps are usually made out of two pieces of material connected to each other at one end with a buckle and sewn at the other end to the shoulder straps. With such a sternum strap, the user cannot adjust the vertical position of the sternum strap to best fit the user's body shape and/or provide better comfort.

Also, although the buckle may allow for one or both of the pieces of material to be threaded through the buckle and adjusted to tighten or loosen the sternum strap across the chest of the user, once adjusted, the sternum strap cannot adapt itself to the natural movement of the chest muscles of the user. Consequently, unless worn loosely and not achieving their intended purpose, conventional sternum straps may lead to further discomfort.

Furthermore, if the user chooses to not buckle the sternum strap, the two pieces of material with the buckle remain hanging while the user wears or carries the backpack. The hanging sternum strap may thus be not only cumbersome, but also uncomfortable.

Accordingly, there is a need for a sternum strap that can be adjusted vertically, that can stretch to adapt itself to the user's body, and that can be stowed when not in use.

SUMMARY

The present invention relates to an apparatus that comprises a body, a pair of shoulder straps attached to the body, a pair of pockets, each of the pair of pockets being formed respectively in each of the pair of shoulder straps, and a sternum strap including two parts connectable with a connector, wherein each of the two parts is attached and can be stowed respectively inside of each of the pair of pockets.

Each of the two parts has a first end attached to a first corner of the corresponding pocket and a second end attached to a second corner of the corresponding pocket, such that the connector can slide up or down along the two parts and, when the two parts are connected with the connector, each of the two parts forms a "V" shape.

Each of the two parts of the sternum strap may be made of, but is not limited to, either a stretchable bungee cord, an elastic webbing, a static cord, or a plastic piping. The connector may be, but is not limited to, either a plastic buckle or a metal G-Hook. The connector may further include an adjustment mechanism to tighten or loosen the sternum strap. Each of the pair of pockets on the shoulder straps may include a closure mechanism, which may be, but is not limited to, a zipper, hook and loop fasteners such as a VELCRO™ strip, an elastic strap, or any combination thereof.

BRIEF DESCRIPTION OF THE DRAWINGS

The present invention will become more fully understood from the detailed description given below and from the accompanying drawings. The drawings are intended to disclose but a few possible examples of the present invention, and thus do not limit the present invention's scope.

DETAILED DESCRIPTION

The present invention generally relates to sternum straps. While a preferred example of a sternum strap is described in detail below in conjunction with a backpack, the sternum strap described herein may also be applied to a broad variety of apparatuses such as safety vests and safety harnesses.

Figure 1:
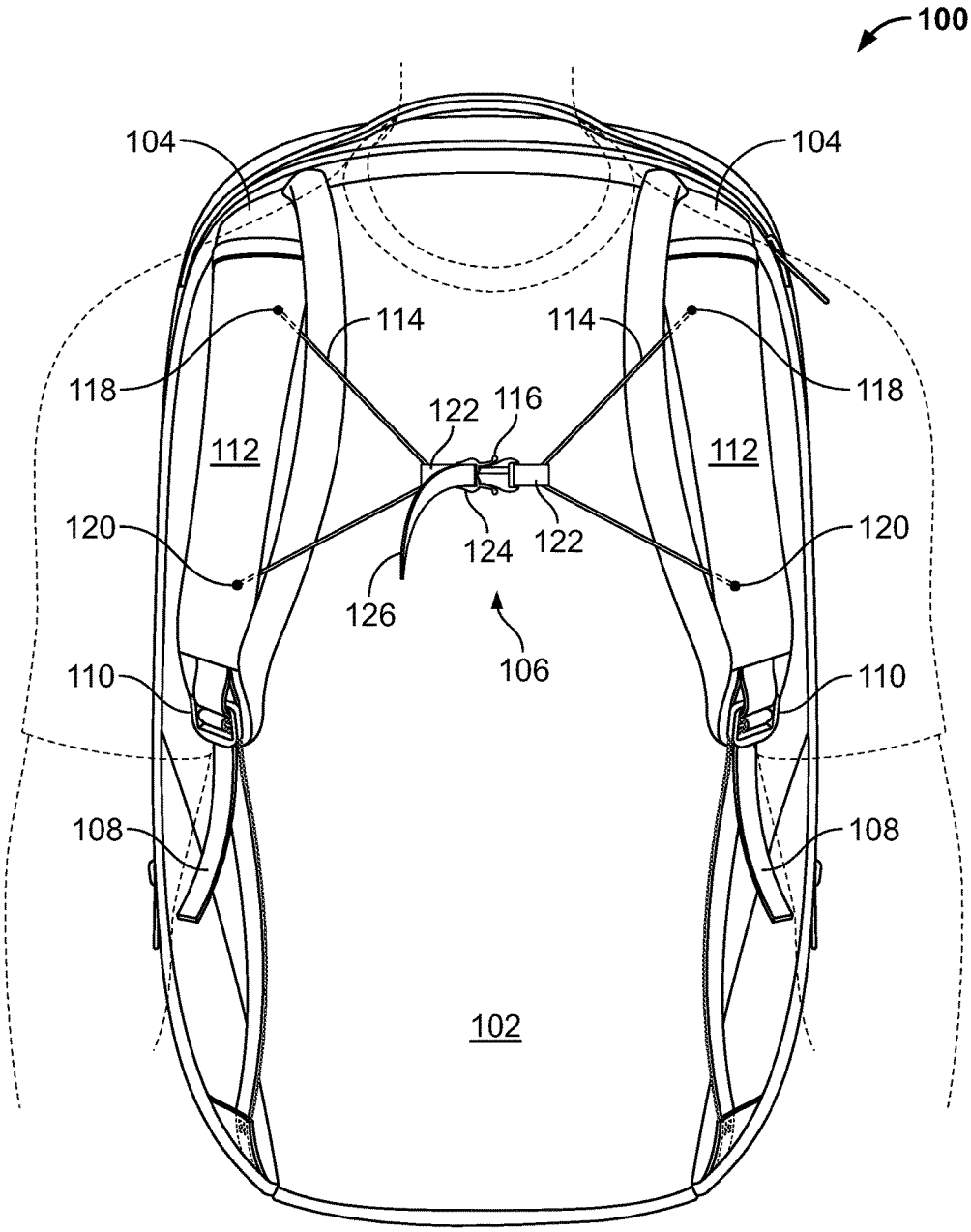
FIG. 1 shows an example of a front view of a connected sternum strap attached to shoulder straps of a backpack in accordance with certain embodiments of the present invention.

One example of a sternum strap attached to shoulder straps of a backpack in accordance with the present invention is shown in FIG. 1. A backpack 100 includes a body 102, a pair of shoulder straps 104, and a sternum strap 106. Each of the pair of shoulder straps 104 may be attached, by sewing for example, at a top end to the body 102. Each of the pair of shoulder straps 104 may be affixed at the bottom end to the body 102 with a piece of material 108, such as a mesh piece strap or a webbing, threaded through an adjusting belt loop 110 mounted on the shoulder strap. A user of the backpack 100 can thus raise or lower the backpack 100 on the user's back by adjusting the piece of material 108 through the adjusting belt loop 110.

Each of the pair of shoulder straps 104 includes a pocket 112 having a vertical opening. The pocket 112 and its vertical opening are not limited to be on the front surface of the corresponding shoulder strap 104. The pocket 112 and its vertical opening may also be on the back surface or on the periphery of the corresponding shoulder strap 104. As will be illustrated later, the purpose of the pockets 112 is to accommodate the sternum strap 106 when the sternum strap 106 is disconnected and not in use. The pocket 112 may have a closure mechanism, which may be, but is not limited to, a zipper, hook and loop fasteners such as a VELCRO™ strip, an elastic strap, or any combination thereof.

The sternum strap 106 includes two parts 114, which are connectable with a connector 116. Each of the two parts 114 is attached respectively to the inside of each of the pair of pockets 112. In particular, each of the two parts 114 has one end attached, by sewing for example, to an inside corner 118 of the corresponding pocket 112 and another end attached, by sewing for example, to another inside corner 120 of the corresponding pocket 112. With the two parts 114 attached to the pair of pockets 112 in such a fashion, each of the two parts 114 forms a "V" shape when the two parts 114 are connected with the connector 116.

The connector 116 may be, but is not limited to, a plastic buckle such as a plastic quick-release buckle or a metal G-Hook. The connector 116 may be mounted on the two parts 114 with two pieces of material 122, such as mesh piece straps or webbings. Each of the two pieces of material 122 may be looped around each end of the buckle and each of the two parts 114, and sewn. As a result, the user of the backpack 100 can freely slide the connector 116 vertically, i.e., up and down, along the two parts 114.

The connector 116 may further include an adjustment mechanism 124 to allow the user to tighten or loosen the sternum strap 106 across the user's chest. For example, the adjustment mechanism 124 may be an adjusting belt loop through which a piece of material 126, such as a mesh piece strap or a webbing, may be threaded. The user may tighten or loosen the sternum strap 106 by adjusting the piece of material 126 through the adjustment mechanism 124. The piece of material 126 may be part of one of the two pieces of material 122. While the adjustment mechanism 124 is shown on one side of the connector 116, a similar adjustment mechanism may also be included on the other side of the connector 116, to provide the user with even more freedom in adjusting the position of the connector 116 and consequently the position of the sternum strap on the user's chest.

The two parts 114 of the sternum strap 106 may be made of, but is not limited to, either a stretchable bungee cord, an elastic webbing, a static cord, or a plastic piping. When the two parts 114 are made of a stretchable material, the sternum strap 106 can adapt itself to the natural movement of the user's chest muscles. It is to be appreciated that the level of comfort is dependent on the elasticity of the material used to make the two parts 114.

Therefore, several aspects of the present invention allow the user of the backpack 100 to adjust the sternum strap 106 to achieve the user's best comfort. Once the user connects the sternum strap 106 with connector 116 across the user's chest, the user may adjust the vertical position of the sternum strap 106 by sliding the connector 116 up or down the two parts 114. The user may further tighten or loosen the sternum strap 106 using the adjustment mechanism 124, while the sternum strap may continuously adapt itself to the natural movement of the user's chest muscles. On the other hand, if the user chooses to not use the sternum strap 106, the user may stow the sternum strap 106 in the pair of pockets 112.

Figure 2:
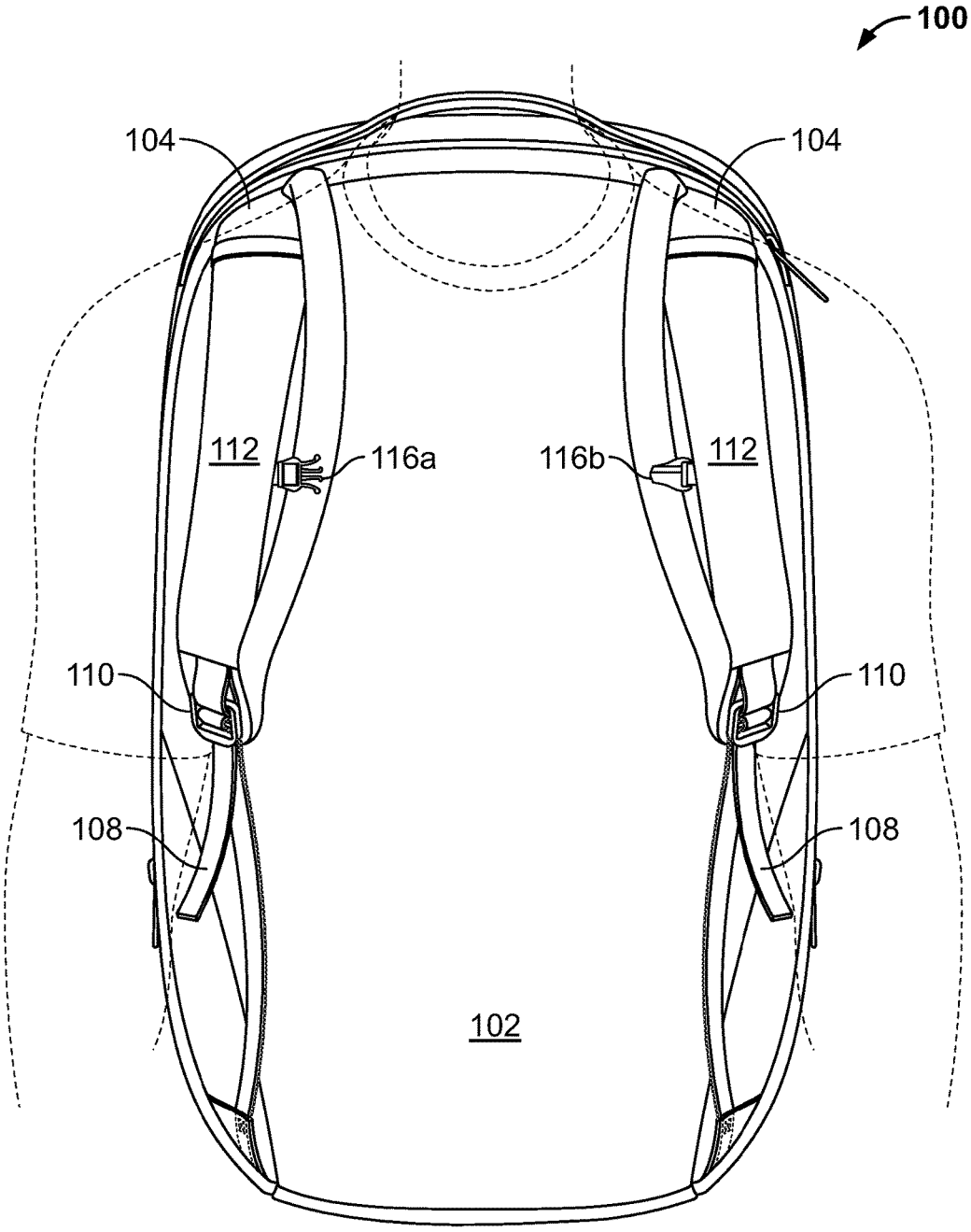
FIG. 2 shows an example of a front view of a disconnected sternum strap partially stowed in pockets in shoulder straps in accordance with certain embodiments of the present invention.
Figure 3:
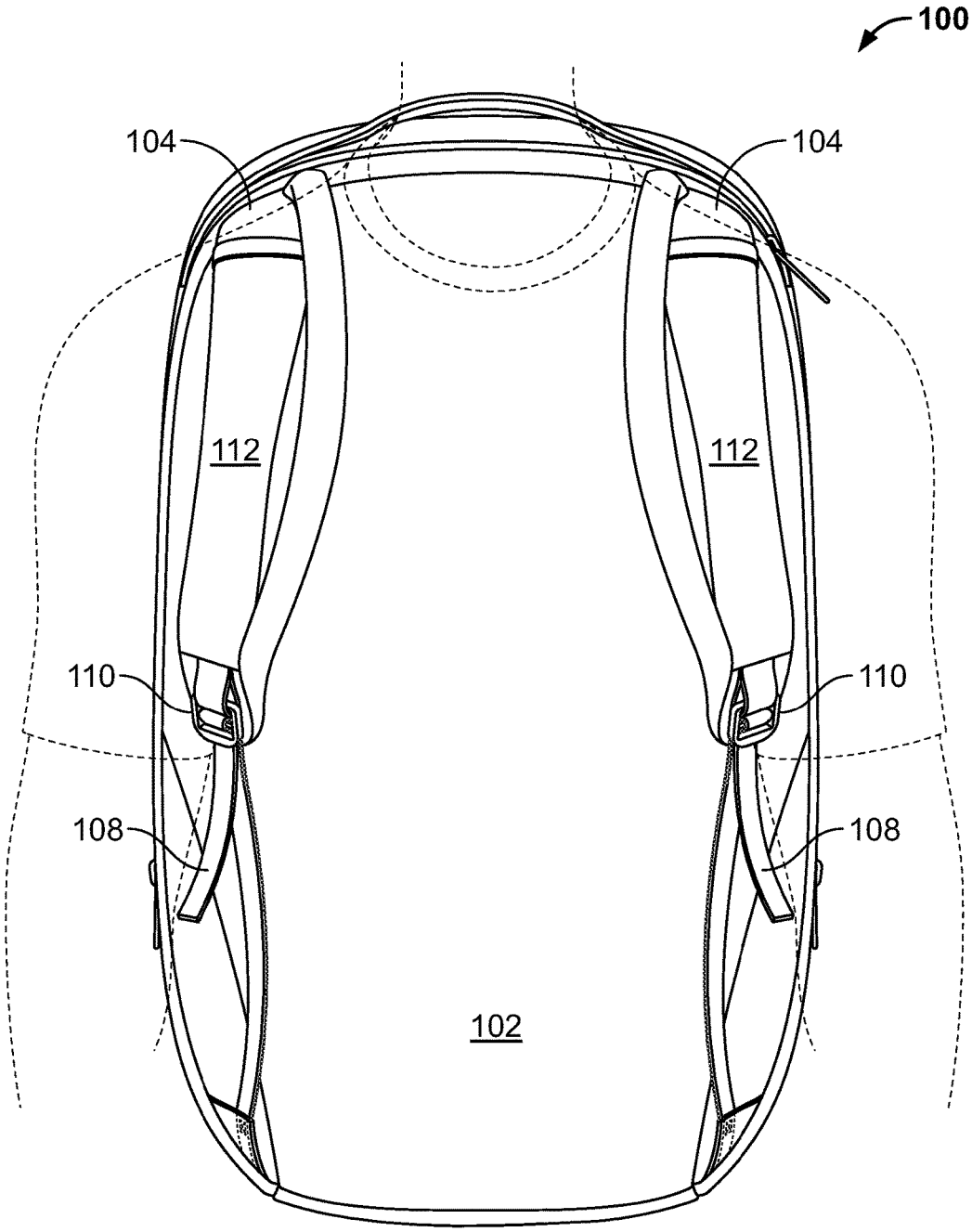
FIG. 3 shows an example of a front view of shoulder straps with a sternum strap completely stowed in pockets in accordance with certain embodiments of the present invention.
Figure 4:
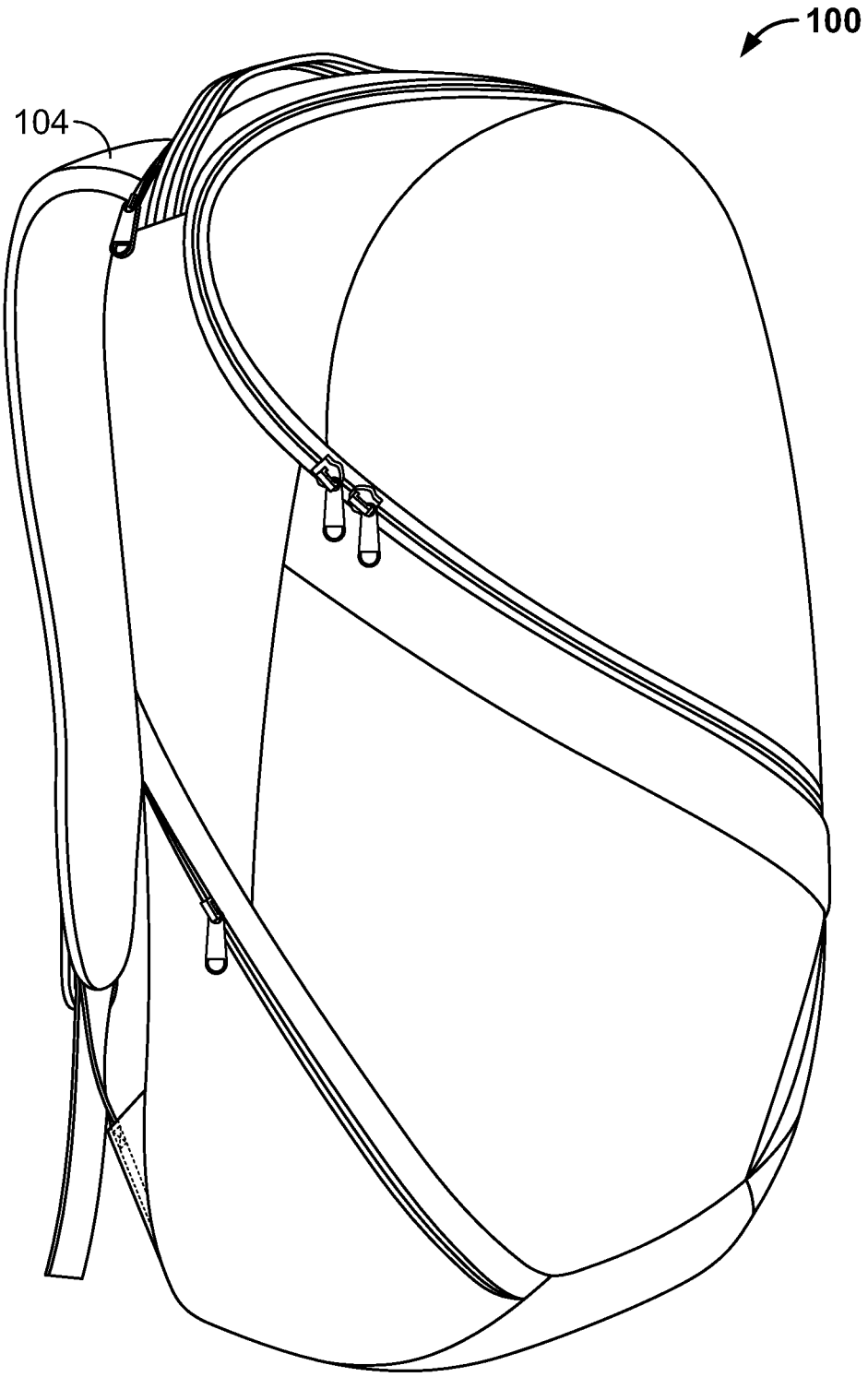
FIG. 4 shows a perspective view of an exemplary backpack with shoulder straps to which a sternum strap may be attached in accordance with certain embodiments of the present invention.

FIG. 2 illustrates an exemplary instance when the sternum strap 106 is partially stowed in the pair of pockets 112. In this case, two unconnected ends 116*a* and 116*b* of the connector 116 are shown outside of the pockets 112, while the two parts 114 of the sternum strap 106 are fully stowed within the pair of pockets 112. FIG. 3 illustrates another exemplary instance when the disconnected sternum strap 106, including the two parts 114 and the connector 116, is completely stowed within the pockets 112. FIG. 4 shows a perspective view of an example of the backpack 100 with shoulder straps 104 to which the sternum strap 106 may be attached.

While various embodiments have been described, other embodiments are plausible. It should be understood that the foregoing descriptions of various examples of a stowable and adjustable sternum strap is not intended to be limiting, and any number of modifications, combinations, and alternatives of the examples may be employed.

The examples described herein are merely illustrative, as numerous other embodiments may be implemented without departing from the spirit and scope of the present invention. Moreover, while certain features of the invention may be described above only in the context of certain examples or configurations, these features may be exchanged, added, and removed from and between the various embodiments or configurations while remaining within the scope of the invention.

We claim:

1. An apparatus, comprising:

a body;

a pair of shoulder straps attached to the body;

a pair of pockets, each of the pair of pockets being formed respectively in each of the pair of shoulder straps; and a sternum strap including two parts connectable with a connector, wherein the connector is mounted onto the two parts using two pieces of material;

each of the two parts is made of a stretchable material and the each of the two parts is attached and is configured to be stowed respectively inside of each of the pair of pockets;

each of the two pieces of material is looped around each end of the connector and each of the two parts so that the connector moves vertically, and wherein each of the two parts has a first end attached to a first inside corner of the corresponding pocket and a second end attached to a second inside corner of the corresponding pocket.

2. The apparatus of claim 1, wherein each of the two parts is configured such that the connector can slide up or down along the two parts and, when the two parts are connected with the connector, each of the two parts forms a "V" shape.

3. The apparatus of claim 1, wherein each of the two parts is made of stretchable bungee cord.

4. The apparatus of claim 1, wherein each of the two parts is made of an elastic webbing.

5. The apparatus of claim 1, wherein each of the two parts is made of a static cord.

6. The apparatus of claim 1, wherein each of the two parts is made of a plastic piping.

7. The apparatus of claim 1, wherein the connector is one of a plastic buckle or a metal G-Hook.

8. The apparatus of claim 1, wherein the connector includes an adjustment mechanism to tighten or loosen the sternum strap.

9. A backpack, comprising:

a body;

a pair of shoulder straps attached to the body;

a pair of pockets, each of the pair of pockets being formed respectively in each of the pair of shoulder straps; and a sternum strap including two parts connectable with a connector, wherein the connector is mounted onto the two parts using two pieces of material;

each of the two parts is made of a stretchable material and the each of the two parts is attached and is configured to be stowed respectively inside of each of the pair of pockets;

each of the two pieces of material is looped around each end of the connector and each of the two parts so that the connector moves vertically, and wherein each of the two parts has a first end attached to a first inside corner of the corresponding pocket and a second end attached to a second inside corner of the corresponding pocket.

10. The backpack of claim 9, wherein each of the two parts is configured such that the connector can slide up or down along the two parts and, when the two parts are connected with the connector, each of the two parts forms a "V" shape.

11. The backpack of claim 9, wherein each of the two parts is made of stretchable bungee cord.

12. The backpack of claim 9, wherein each of the two parts is made of an elastic webbing.

13. The backpack of claim 9, wherein each of the two parts is made of a static cord.

14. The backpack of claim 9, wherein each of the two parts is made of a plastic piping.

15. The backpack of claim 9, wherein the connector is one of a plastic buckle or a metal G-Hook.

16. The backpack of claim 9, wherein the connector includes an adjustment mechanism to tighten or loosen the sternum strap.

* * * * *